US008867981B2

(12) United States Patent
Hironaka et al.

(10) Patent No.: US 8,867,981 B2
(45) Date of Patent: Oct. 21, 2014

(54) IMAGE FORMING APPARATUS AND CHARGE ELIMINATING DEVICE

(75) Inventors: Keita Hironaka, Obu (JP); Motoaki Mushika, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 81 days.

(21) Appl. No.: 13/430,197

(22) Filed: Mar. 26, 2012

(65) Prior Publication Data

US 2013/0051883 A1 Feb. 28, 2013

(30) Foreign Application Priority Data

Aug. 31, 2011 (JP) ..... 2011-188796

(51) Int. Cl.
*G03G 15/00* (2006.01)
*G03G 15/16* (2006.01)

(52) U.S. Cl.
CPC ..... *G03G 15/168* (2013.01)
USPC ..... 399/388; 399/372; 399/394

(58) Field of Classification Search
CPC ..... G03G 15/0266; G03G 15/1645; B65H 2301/5321; H02K 11/0089; H05F 3/02; H05F 3/04
USPC ..... 361/221; 399/372, 388, 394
See application file for complete search history.

(56) References Cited

U.S. PATENT DOCUMENTS

| | | | | |
|---|---|---|---|---|
| 6,618,576 | B2 * | 9/2003 | Kanari et al. | 399/388 |
| 6,970,676 | B2 * | 11/2005 | Ito et al. | 399/315 |
| 7,080,835 | B2 * | 7/2006 | Oikawa et al. | 271/208 |
| 7,641,188 | B2 * | 1/2010 | Hiura et al. | 271/122 |
| 2009/0129831 | A1 * | 5/2009 | Sakashita et al. | 399/309 |

FOREIGN PATENT DOCUMENTS

| | | | |
|---|---|---|---|
| JP | 07-230220 | | 8/1995 |
| JP | 2002226074 A | * | 8/2002 |
| JP | 2009-003019 | | 1/2009 |

* cited by examiner

*Primary Examiner* — Daniel J Colilla
*Assistant Examiner* — John M Royston
(74) *Attorney, Agent, or Firm* — Banner & Witcoff, Ltd.

(57) ABSTRACT

An image forming apparatus includes: a photosensitive member configured to form a developer image thereon; a transfer member configured to transfer the developer image formed on the photosensitive member to a sheet; a conveyance roller configured to convey the sheet toward and between the photosensitive member and the transfer member; and a charge removal member configured to remove charges on the conveyance roller. The conveyance roller is arranged to face a surface of the sheet to which the transfer member faces. The charge removal member is provided at a position at which the charge removal member is not in contact with the conveyance roller, within a range in which charges on the conveyance roller can be discharged toward the charge removal member.

9 Claims, 8 Drawing Sheets

IMAGE FORMING APPARATUS AND CHARGE ELIMINATING DEVICE

CROSS-REFERENCE TO RELATED APPLICATION

This application is based upon and claims the benefit of priority of Japanese Patent Application No. 2011-188796 filed on Aug. 31, 2011, the contents of which are incorporated herein by reference in its entirety.

BACKGROUND

The invention relates to an image forming apparatus.

An image forming apparatus is provided with a charge removal brush for removing charges on the register rollers, thereby removing the charges on the register rollers.

In the meantime, if the grounded charge removal brush is brought into contact with the register rollers all the time, when the sheet is held between the transfer rollers, transfer current applied to the sheet by the transfer unit may be transferred along the sheet and the register rollers and then leaked from the charge removal brush. Thereby, the transfer unit cannot sufficiently apply a transfer bias, which is required to transfer the toner image on the photosensitive member to the sheet, to the sheet.

Thus, the charge removal brush is configured to make contact/separate with/from the register rollers when forming an image and when not forming an image.

SUMMARY

However, when the charge removal brush is configured to make contact/separate with/from the register rollers, a configuration of the apparatus body becomes complicated.

Accordingly, an object of the invention is to provide an image forming apparatus capable of simplifying a configuration of an image forming apparatus body and favorably performing a transfer operation.

The aspect of the disclosure provides an image forming apparatus including a photosensitive member; a transfer member; a conveyance roller, and a charge removal member. The photosensitive member is configured to form a developer image thereon. The transfer member is configured to transfer the developer image formed on the photosensitive member to a sheet. The conveyance roller is configured to convey the sheet toward between the photosensitive member and the transfer member. The charge removal member is configured to remove charges on the conveyance roller. The conveyance roller is arranged to face a surface of the sheet to which the transfer member faces. The charge removal member is provided at a position at which the charge removal member is not in contact with the conveyance roller, within a range in which the charges on the conveyance roller can be discharged toward the charge removal member.

DESCRIPTION OF EXEMPLARY EMBODIMENTS

1. Overall Configuration of Laser Printer

Figure 1:
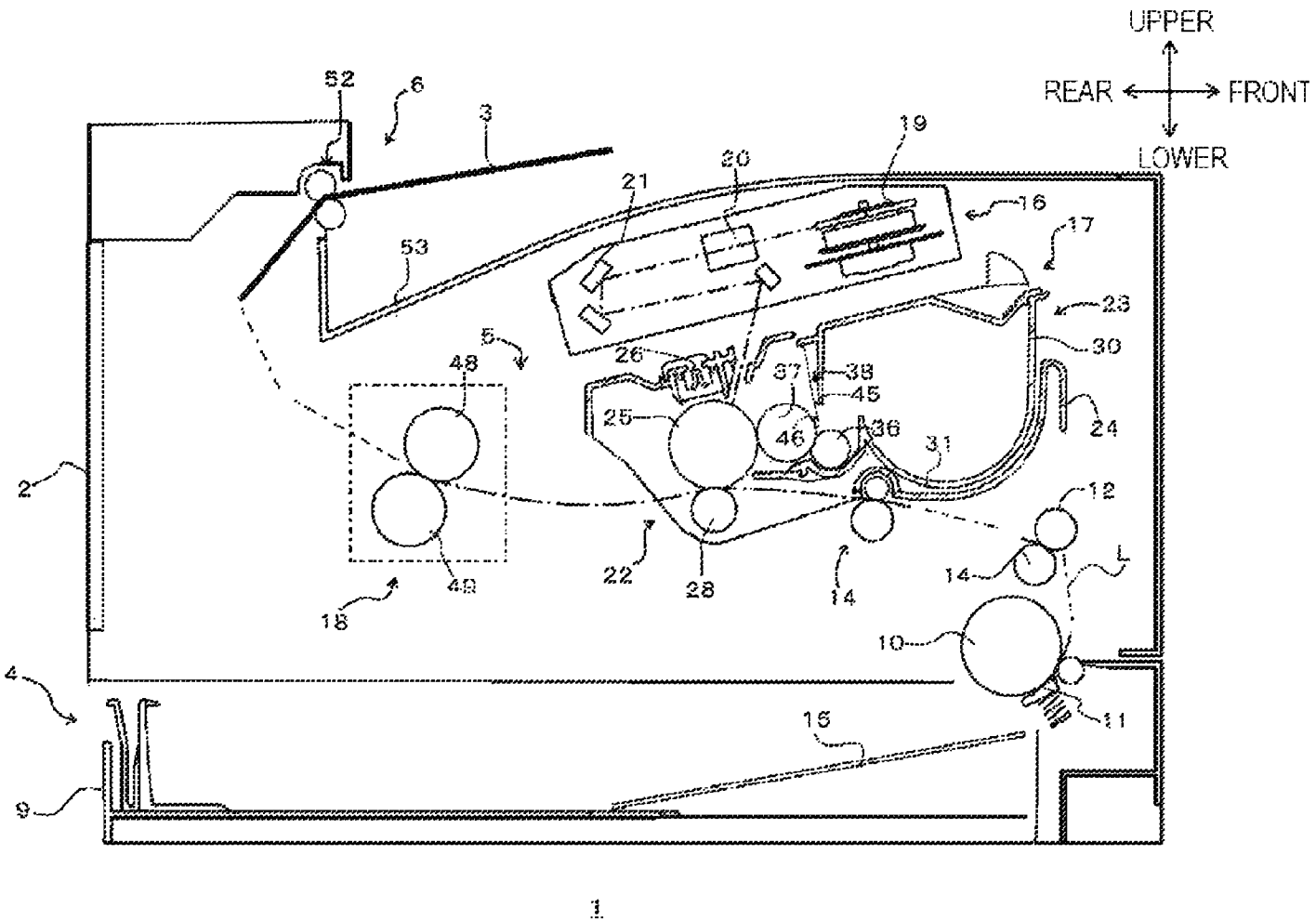
FIG. 1 is a pictorial side sectional view of a laser printer.

As shown in FIG. 1, a laser printer 1 has a feeder unit 4 for feeding a sheet 3 into a body casing 2 (which is an example of an image forming apparatus body), an image forming unit 5 for forming an image on the fed sheet and a sheet discharge part 6 for discharging the sheet 3 having image formed thereon.

In the meantime, regarding the laser printer 1, the directions are described, based on directions indicated when the printer is positioned in a horizontal direction, specifically direction arrows shown in the respective drawings. The left-right direction and the width direction are the same.

<Feeder Unit>

The feeder unit 4 has a sheet feeding tray 9, a sheet feeding roller 10, a sheet feeding pad 11, a pinch roller 14*a* that is an example of the register roller, a register roller 14*b* that is an example of the conveyance roller and the register roller and a sheet pressing plate 15. The uppermost sheet 3 on the sheet pressing plate 15 is delivered one by one by the sheet feeding roller 10 and the sheet feeding pad 11, passes through the various rollers and is conveyed to the image forming unit 5 along a conveyance path L shown with a dashed-dotted line.

<Image Forming Unit>

The image forming unit 5 has a scanner unit 16, a process unit 17 (which is an example of a photosensitive device) and a fixing part 18.

<Scanner Unit>

The scanner unit 16 is provided at an upper part in the body casing 2 and has a laser light emitting part (not shown), a polygon mirror 19 to be rotated, a lens 20 and a plurality of reflecting mirrors 21. A laser beam based on image data, which is emitted from the laser light emitting part, is reflected on the polygon mirror 19, passes through or is reflected on the lens 20 and the reflecting mirrors 21 and is then scanned on a surface of a photosensitive drum 25 of the process unit 17, as shown with a dot-dashed line.

<Process Unit>

Figure 2:
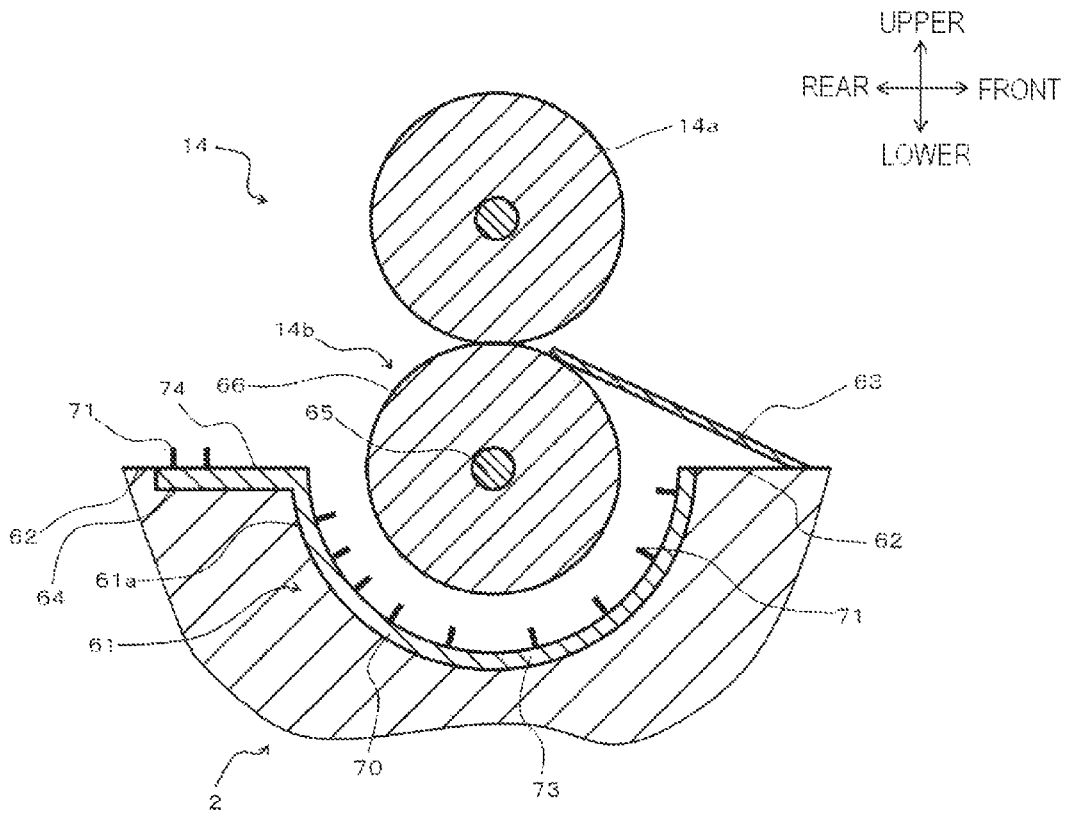
FIG. 2 is a pictorial side sectional view showing a structure around register rollers.

The process unit 17 is arranged below the scanner 6 in the body casing 2 and is detachably mounted to the body casing 2. As shown in FIG. 2, the process unit 17 has a drum unit 22 that is detachably mounted to the body casing 2 and a developing unit 23 that is detachably mounted to the drum unit 22.

As shown in FIG. 2, the drum unit 22 has a drum frame 24, the photosensitive drum 25 provided in the drum frame 24, a scorotron-type charger 26 and a transfer roller 28 that is an example of the transfer member. The photosensitive drum 25 is rotatably supported to the drum frame 24. The scorotron-type charger 26 is supported to the drum frame 24 above the photosensitive drum 25 at an interval with the photosensitive drum 25. The transfer roller 28 is arranged to face the photosensitive drum 25 from a lower side of the photosensitive drum and is rotatably supported to the drum frame 24.

The developing unit 23 has a developing frame 30, a developing roller 37, a layer thickness regulation blade 38, a supply roller 36 and a toner hopper 31. The developing roller 37 and the supply roller 36 are rotatably supported to the developing frame 30. The layer thickness regulation blade 38 has a plate spring member 45 having a thin plate shape and a pressure-contact rubber 46 that is provided at a lower end portion of the plate spring member 45. An upper end portion of the plate spring member 45 is fixed to the developing frame 30 and the pressure-contact rubber 46 presses a surface of the developing roller 37 by elastic force of the plate spring 45. The toner hopper 31 accommodates therein toner that is positively charged.

The toner in the toner hopper 31 is supplied to the developing roller 37 as the supply roller 36 rotates. At this time, the toner is positively friction-charged between the supply roller 36 and the developing roller 37. The toner supplied onto the developing roller 37 is introduced between the layer thickness regulation blade 38 and the developing roller 37 as the developing roller 37 is rotated, and is carried on the developing roller 37 as a thin layer having a predetermined thickness.

A surface of the photosensitive drum 25 is positively charged uniformly by the scorotron-type charger 26 and then exposed by the scanning of the laser beam emitted from the scanner unit 16, so that an electrostatic latent image is formed thereon. Then, when the developing roller 37 is rotated and thus the toner carried on the developing roller 31 is opposed to and brought into contact with the photosensitive drum 25, the toner is supplied to the electrostatic latent image formed on the surface of the photosensitive drum 25, so that the electrostatic latent image becomes visible. The visible toner image is transferred onto the sheet 3 conveyed between the photosensitive drum 25 and the transfer roller 28 as the transfer bias is applied by the transfer roller 28 thereto. Here, the sheet 3 is held between a pair of register rollers 14 with a leading end portion of the sheet 3 being held between the transfer roller 28 and the photosensitive drum 25.

<Fixing Part>

As shown in FIG. 1, the fixing part 18 is provided at a rear side of the process unit 17. The fixing part 18 has a heating roller 48 and a pressing roller 49 that is pressure-contacted to the heating roller 48 from a lower side of the heating roller. In the fixing part 18, the toner transferred to the sheet 3 at the transfer position is heat-fixed while the sheet 4 passes between the heating roller 48 and the pressing roller 49. Then, the sheet 3 is conveyed to the sheet discharge part 6 by a pair of sheet discharge rollers 52.

<Sheet Discharge Part>

The sheet discharge part 6 has the sheet discharge rollers 52 and a sheet discharge tray 53. The sheet 3 conveyed from the fixing part 18 is discharged onto the sheet discharge tray 53 by the sheet discharge rollers 52.

<Specific Configuration Around Register Rollers>

Figure 3:
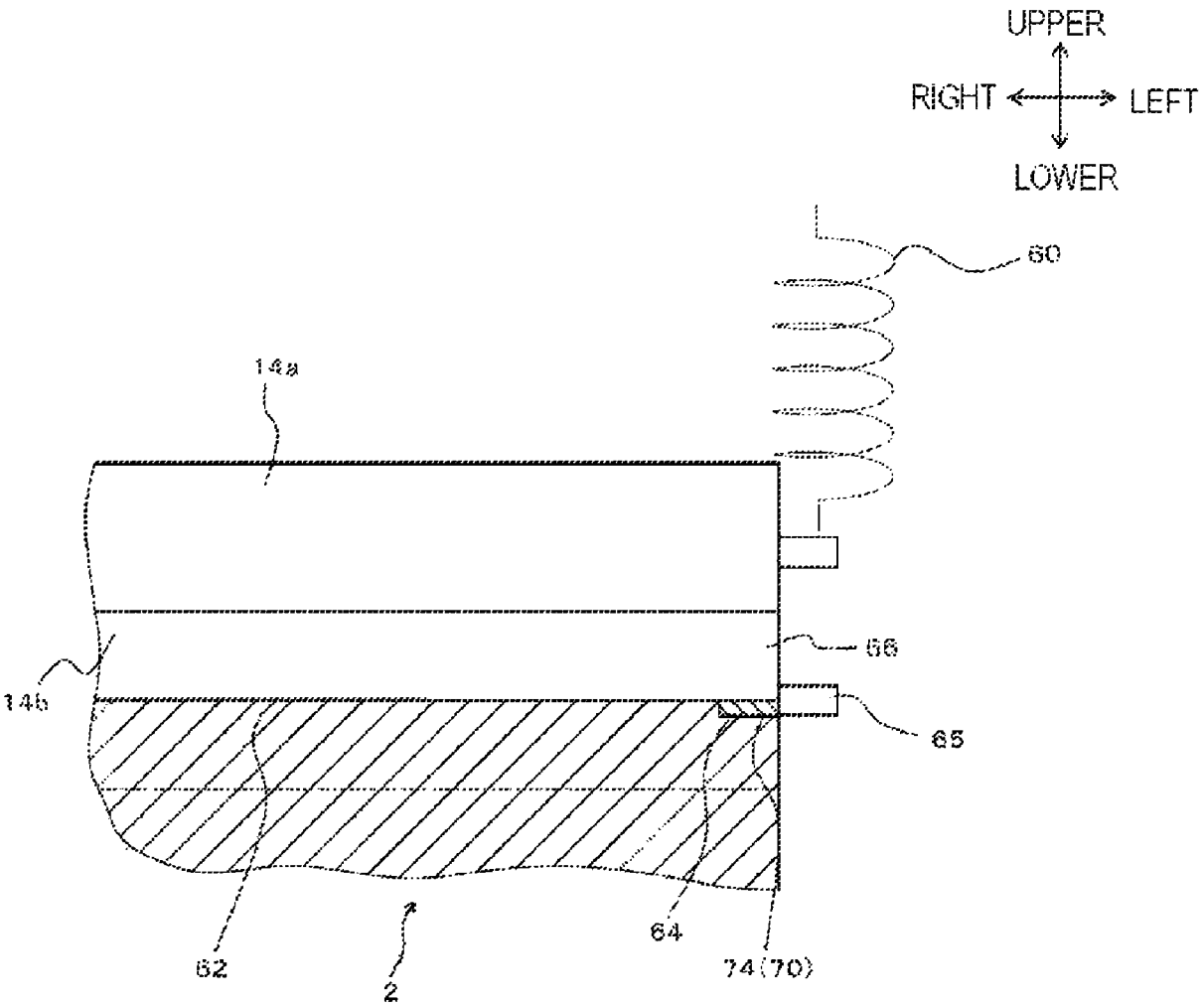
FIG. 3 is a rear view of the register rollers.

FIG. 2 is a pictorial view showing the surrounding of the register rollers 14, when seen from the left-right direction. FIG. 3 shows the surrounding of the register rollers 14 from the rear toward the front. In FIG. 3, only the left surrounding of the register rollers 14 is shown for convenience' sake. Before the sheet 3 is conveyed between the photosensitive drum 25 and the transfer roller 28, the leading end portion of the sheet 3 collides with a pinch roller 14*a*, so that the pinch roller corrects skew of the sheet 3. The pinch roller 14*a* is a metal roller extending in the left-right direction.

The pinch roller 14*a* is provided so that it can be moved vertically with respect to the drum unit 22. The pinch roller 14*a* is rotatably held to the drum unit 22. At a state in which the drum unit 22 is mounted in the body casing 2, the pinch roller 14*a* is pressed toward the register roller 14*b* by a spring member 60 (refer to FIG. 3) provided to the body casing 2. A right end portion of the pinch roller 14*a* is also pressed toward the register roller 14*b* by the spring member 60.

The register roller 14*h* has a rotary shaft 65 extending in the left-right direction and a roller body 66 that covers a circumferential surface of the rotary shaft 65. The roller body 66 is a rubber roller that is formed of ethylene propylene rubber and extends in the left-right direction. The register roller 14*b* is rotatably provided to the body casing 2.

The body casing 2 has a register roller accommodation part 61, a sheet conveyance path 62 that is an example of the facing surface and a sheet conveyance guide 63 that is an example of the guide member.

The register roller accommodation part 61 has a substantially circular arc shape, when seen from a side, and has an accommodating surface 61*a* that is concave downward from the sheet conveyance path 62. The register roller accommodation part 61 accommodates the register roller 14*b* so that it covers a circumferential surface of the register roller 14*b* while exposing a part of the register roller 14*b* facing the pinch roller 14*a*.

The sheet conveyance path 62 is a surface facing the body casing 2, which is opposed to a bottom surface of the drum unit 22 with the drum unit 22 being mounted to the body casing 2. The sheet conveyance path 62 is opposed to a surface of the sheet 3 facing the transfer roller with the sheet 3 being held between the pinch roller 14*a* and the register roller 14*b* and between the photosensitive drum 25 and the transfer roller 28.

The sheet conveyance guide 63 is provided at an upstream side of the register roller 14*b* with respect to the conveyance direction of the sheet 3. The sheet conveyance guide 63 is a resin film having a flat plate shape, when seen from a plane extending in the left-right direction. The sheet conveyance guide 63 has one end portion that is fixed to the sheet conveyance path 62 and the other end portion that is placed on the register roller 14*b*.

A charge removal member 70 is provided between the accommodating surface 61*a* and the circumferential surface of the register roller 14*b*. The charge removal member 70 is nonwoven fabric made of nylon and having a plurality of bristles 71. The charge removal member 71 extends along the register roller 14*b* in the left-right direction. The bristles 71 of the charge removal member 70 and a surface of the charge removal member 70 facing the register roller 14*b* are plated with conductive metal (for example, silver and the like). The bristles 71 protrude toward the surface of the register roller 14*b*.

The charge removal member 70 has a facing part 73 that faces the surface of the register roller 14*b* and an extension part 74 that extends from an outer edge of the facing part 73 toward a downstream side with respect to the conveyance direction of the sheet 3. The bristles 71 are provided on surfaces of the facing part 73 and extension part 74.

The facing part 73 is arranged along the accommodating surface 61*a* so that the bristles 71 are spaced from the register roller 14*b* at a predetermined distance. The facing part 73 is arranged so that it faces the circumferential surface of a substantial lower half part of the register roller 14*b*. The facing part 73 is provided at a position at Which it is not in contact with the circumferential surface of the register roller 14*b* within a range in which the charges accumulated on the register roller 14*b* can be discharged toward the bristles 71. Specifically, the facing part 73 is arranged so that an interval between the register roller 14*b* and leading end portions of the bristles become 3 mm or smaller. Thereby, the charges accumulated on the surface of the register roller 14*b* are effectively removed.

The extension part 74 extends in a direction (direction following the front-rear direction) intersecting with a rotary axis line of the register roller 14*b* so that it becomes distant from the register roller 14*b*. The extension part 74 is provided at one end portion of the facing part 73 (register roller 14*h*) in the left-right direction, when seen from the front-rear direction (refer to FIG. 3). The extension part 74 is fitted in a recess part 64 provided to the sheet conveyance path 62. The recess part 64 is provided at a position corresponding to the extension part 74 and is formed at the sheet conveyance path 62 so that it is concave downward.

<Description of Charge Removal of Register Roller>

Figure 4:
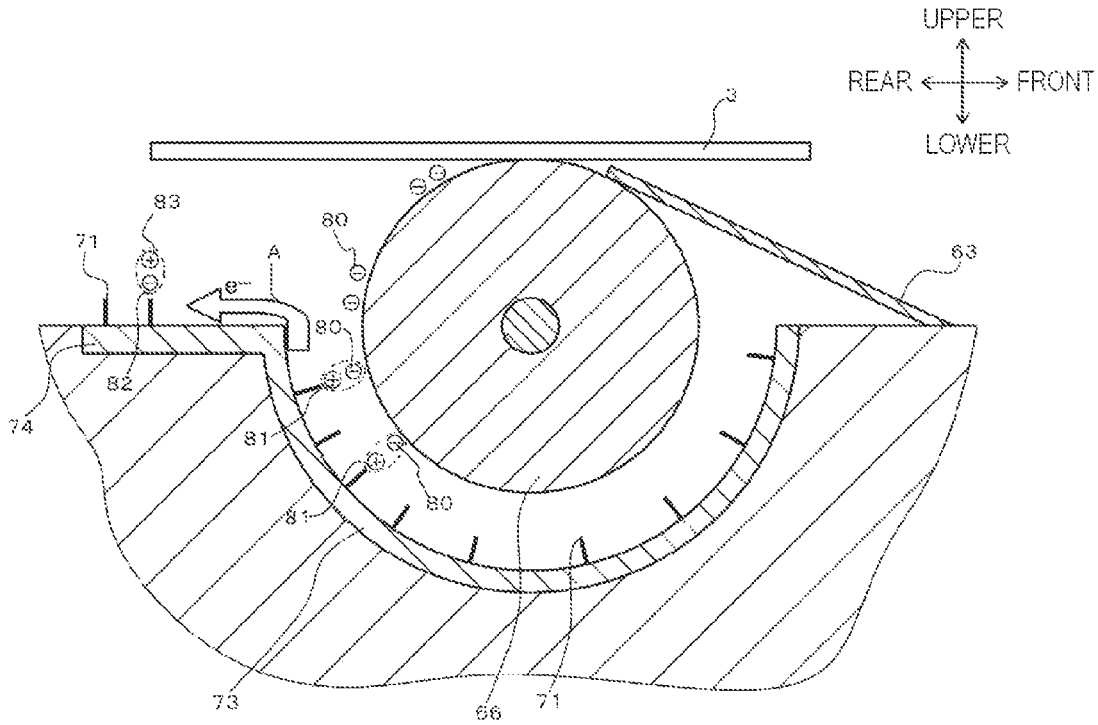
FIG. 4 is a pictorial view showing moving of charges on a surface of the register roller.

As shown in FIG. 4, negative charges 80 due to friction with the sheet 3 are accumulated on the surface of the register roller 14*b*.

As the negative charges 80 are accumulated on the surface of the register roller 14*b*, positive charges are collected to the leading end portions of the bristles 71 of the facing part 73. When the negative charges 80 are continuously accumulated and thus the surface of the register roller 14*b* becomes a predetermined voltage, a corona discharge is generated between the leading end portions of the bristles 71 and the surface of the register roller 14*b*.

When the corona discharge is generated, gas molecules in the air are dissociated in the vicinity of the leading end portions of the bristles 71, so that a positive ion 81 is generated. The positive ion 81 is combined with the negative charges 80 accumulated on the surface of the register roller 14*b*. Thereby, the charges of the register roller 14*b* are removed.

Electrons 82 in the charge removal member 82 are moved toward the extension part 74, which is arranged at the position distant from the roller body 66 of the register roller 14*b*, by influence of an electric field of the negative charges 80 accumulated on the surface of the register roller 14*b*. An arrow A shown in FIG. 4 indicates the moving of the electrons 82 in the charge removal member 70.

The electrons 82 are collected at the leading end portions of the bristles 71 of the extension part 74, so that a corona discharge is generated. By the corona discharge, gas molecules in the air are dissociated in the vicinity of the leading end portions of the bristles 71 of the extension part 74, so that a positive ion 83 is generated. The positive ion 83 is combined with the electrons 82 collected at the bristle 71 of the extension part 74 and are thus neutralized. Therefore, since the electrons 82 are appropriately consumed in the charge removal member 70 by the neutralization with the positive ion 83, the negative charges 80 of the surface of the register roller 14*b* can be continuously removed without the accumulation of the electrons 82 in the charge removal member 70.

From the above configuration, this illustrative embodiment can realize following effects.

The charge removal member 70 is arranged so that it does not contact the register roller 14*b* within a dischargeable range. Accordingly, it is possible to remove the charges on the register roller 14*b*. The charge removal member 70 is arranged so that it does not contact the register roller 14*b* even when the sheet 3 is held between the pinch roller 14*a* and the register roller 14*b* with being held between the transfer roller 28 and the photosensitive drum 25. Therefore, the transfer bias is not leaked via the charge removal member 70, so that the favorable transfer is possible.

Here, a problem is described which is caused when transferring the toner image, as the register roller 14*b* is negatively charged due to the friction with the sheet 3.

First, as the negative charges are accumulated on the register roller 14*b*, the surface (lower surface) of the sheet 3 facing the transfer roller 28 is positively charged, which is the opposite polarity to that of the register roller 14*b*. At the state in which the lower surface of the sheet 3 is positively charged, the sheet 3 is introduced between the transfer roller 28 and the photosensitive drum 25. When the lower surface of the sheet 3 is positively charged, following problems may be caused when transferring the toner image.

First, when the toner image on the photosensitive drum 25 is positively charged and the negative bias is applied to the transfer roller 28, the positive charges on the lower surface of the sheet 3 and the negative charges on the transfer roller 28 may be cancelled each other. Thereby, the transfer roller 28 cannot apply an appropriate transfer bias to the toner image on the photosensitive drum 25. Therefore, when the lower surface of the sheet 3 is strongly positively charged, a printing defect may be caused.

When the toner image on the photosensitive drum 25 is negatively charged, the toner image on the photosensitive drum 25 is influenced by the electric field of the positive charges on the lower surface of the sheet 3. Hence, a transfer defect (transfer spread) that the toner image is transferred onto the sheet 3 before it is transferred to the sheet 3 by the transfer roller 28 may be caused.

However, according to this illustrative embodiment, since the charges on the surface of the register roller 14*b* are favorably removed, the lower surface of the sheet 3 is less strongly positively charged. As a result, the above problems are reduced and the favorable transfer is possible.

The charge removal member 70 is provided with respect to the register roller 14*b*. Thus, it is possible to reduce that the lower surface of the sheet 3 is positively charged just before the sheet 3 is held between the transfer roller 28 and the photosensitive drum 25.

Since the charge removal member 70 is made of the non-woven fabric, it is possible to favorably remove the charges on the register roller 14*b* while saving a space in the laser printer 1.

The charge removal member 70 is provided with the extension part 74 that extends from the outer edge of the facing part 73 toward a direction away from the roller body 66. The charges (electrons 82) having the opposite polarity to that of the charges (positive charges in the above illustrative embodiment) collected at the bristles 71 of the facing part 73 are collected at the extension part 74. The electrons 82 are neutralized by the positive ion 83 generated by the corona discharge. Accordingly, the charges of the register roller 14*b* can be continuously removed without the accumulation of the charges in the charge removal member 70. Since a configuration for grounding the charge removal member 70 is not required, it is possible to simply configure the laser printer 1.

Since the extension part 74 extends in the direction intersecting with the rotary shaft 65, it is possible to effectively neutralize the negative charges collected at the extension part 74 without the influence of the charges accumulated on the surface of the register roller 14*b*.

The sheet conveyance guide 63 that guides the sheet toward and between the pinch roller 14*a* and the register roller 14*b* is provided at the upstream side of the register roller 14*b* with regard to the conveyance direction of the sheet 3. In this case, the extension part 74 is provided at the downstream side of the register roller 14*b* with respect to the conveyance direction of the sheet 3. Thereby, it is possible to favorably remove the charges on the register roller 14*b* while favorably conveying the sheet 3.

The sheet conveyance path 62 is formed with the recess part 64 that is concave in the direction away from the surface of the sheet 3 facing the transfer roller 28, when seen from the rotary shaft 65, and in which the extension part 74 is fitted. Thereby, it is possible to prevent the extension part 74 from interfering with the conveyance of the sheet 3.

Both end portions of the pinch roller 14*a* in the left-right direction are pressed toward the register roller 14*b* by the spring members 60. Thereby, both end portions of the register roller 14*b* in the left-right direction can be charged more easily by the friction with the sheet 3. However, the charge removal member 70 is provided to at least both end portions of the register roller 14*b* in the left-right direction. Accordingly, even in this case, the charges on the register roller 14*b* are favorably removed.

Embodiment and Comparative Example

Printing evaluation was performed for following an embodiment and a comparative example.

1. Embodiment

Regarding the charge removal member 70, 'FC Series Anti-static FELT/FN-50' (FANCY Co., Ltd) was used. As shown in FIG. 2, the charge removal member 70 has the facing part 73 and the extension part 74. The opposing part 73 is arranged to face the substantial lower half part of the register roller 14*b*. The interval between the bristles 71 of the facing part 73 and the circumferential surface of the register roller 14*b* is about 3 mm. The lengths of the extension part 74 in the left-right and front-rear directions are about 10 mm.

2. Comparative Example

Figure 5:
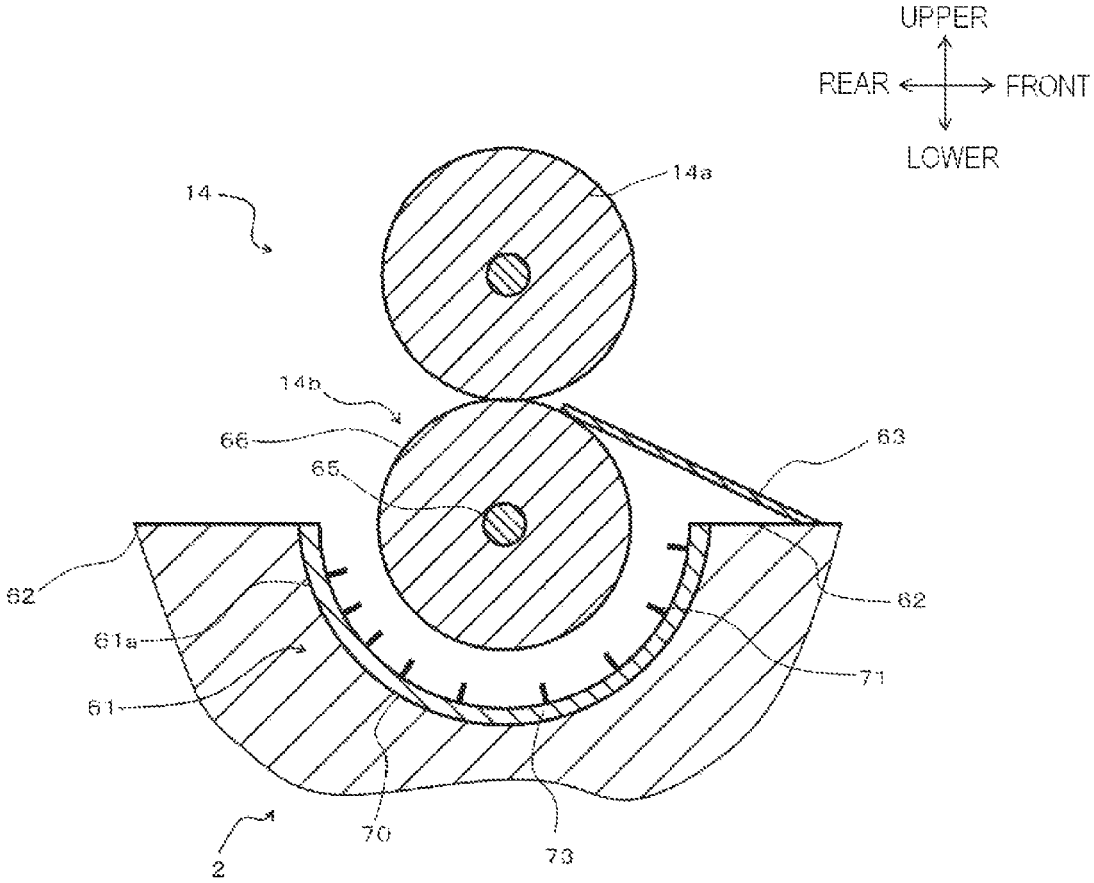
FIG. 5 is a pictorial side sectional view showing a structure around register rollers of a comparative example.

Regarding the charge removal member 70, 'FC Series Anti-static FELT/FN-50' (FANCY Co., Ltd) was used. As shown in FIG. 5, the charge removal member 70 has only the facing part 73 and does not have the extension part 74. The opposing part 73 is arranged to face the substantial lower half part of the register roller 14*b*. The interval between the bristles 71 of the facing part 73 and the circumferential surface of the register roller 14*b* is about 3 mm.

3. Printing Evaluation

Regarding the embodiment and comparative example, a printing operation was performed with a printing area percentage 100%, under environments of room temperature 23° C. and relative humidity 10%.

As a result, in the comparative example, four white points (parts to which toner was not transferred) having a diameter of about 2 mm were found in a printed image. However, in the embodiment, no white point was found.

Modified Embodiment

Figure 6:
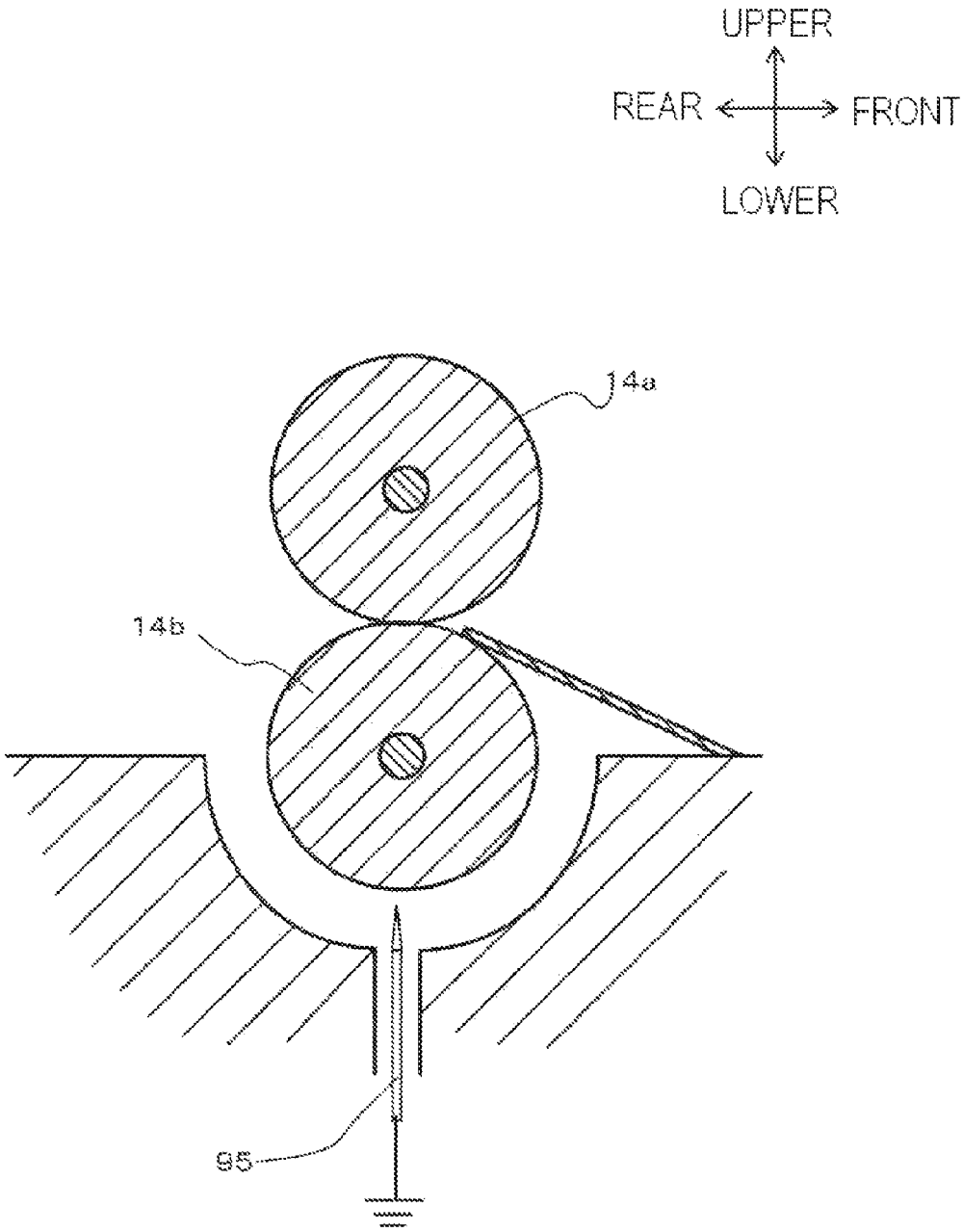
FIG. 6 shows a modified embodiment of a charge removal member.

In FIG. 6, a charge removal needle 95 serving as the charge removal member is arranged not to contact the register roller 14*b*. The charge removal needle 95 is grounded. Even with this configuration, it is possible to favorably remove the charges on the register roller 14*b* while reducing the leakage of the transfer bias. When the charge removal member is grounded, the same effects as the illustrative embodiment can be realized even with the charge removal member 70 that is made of the nonwoven fabric and includes only the facing part 73 without the extension part 74.

Figure 7:
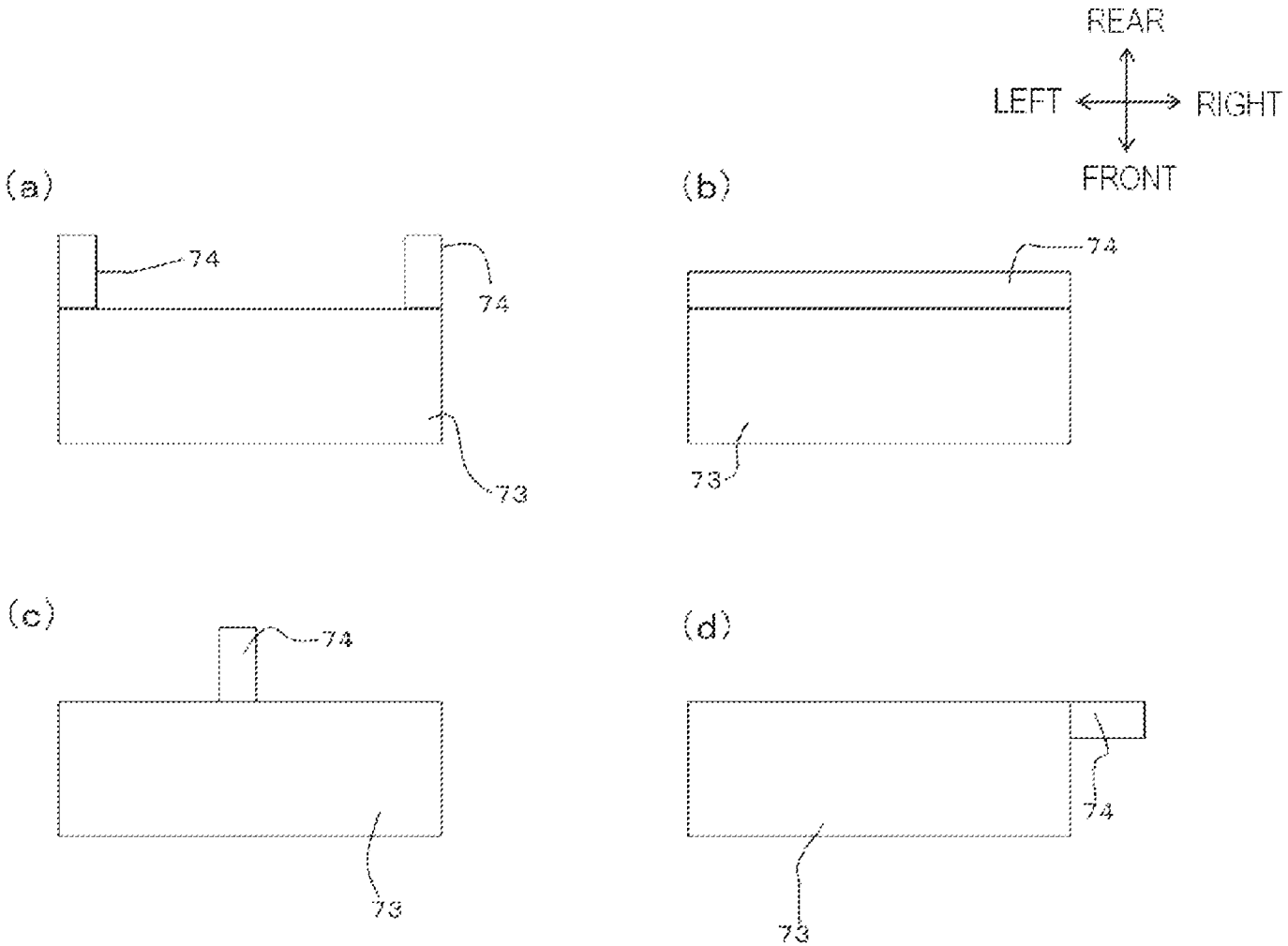
FIGS. 7A to 7D shows a modified embodiment of an extension part.

The shape of the nonwoven fabric is not limited to the above illustrative embodiment. As shown in FIG. 7A, the extension part 74 may protrude from left and right end portions of the outer edge of the facing part 73. As shown in FIG. 7B, the extension part 74 may be continuous in the left-right direction. As shown in FIG. 7C, the extension part 74 may protrude from a substantially central part of the outer edge of the facing part 73 in the left-right direction. As shown in FIG. 7D, the extension part 74 may protrude from the outer edge of the facing part 73 along the left-right direction.

Figure 8:
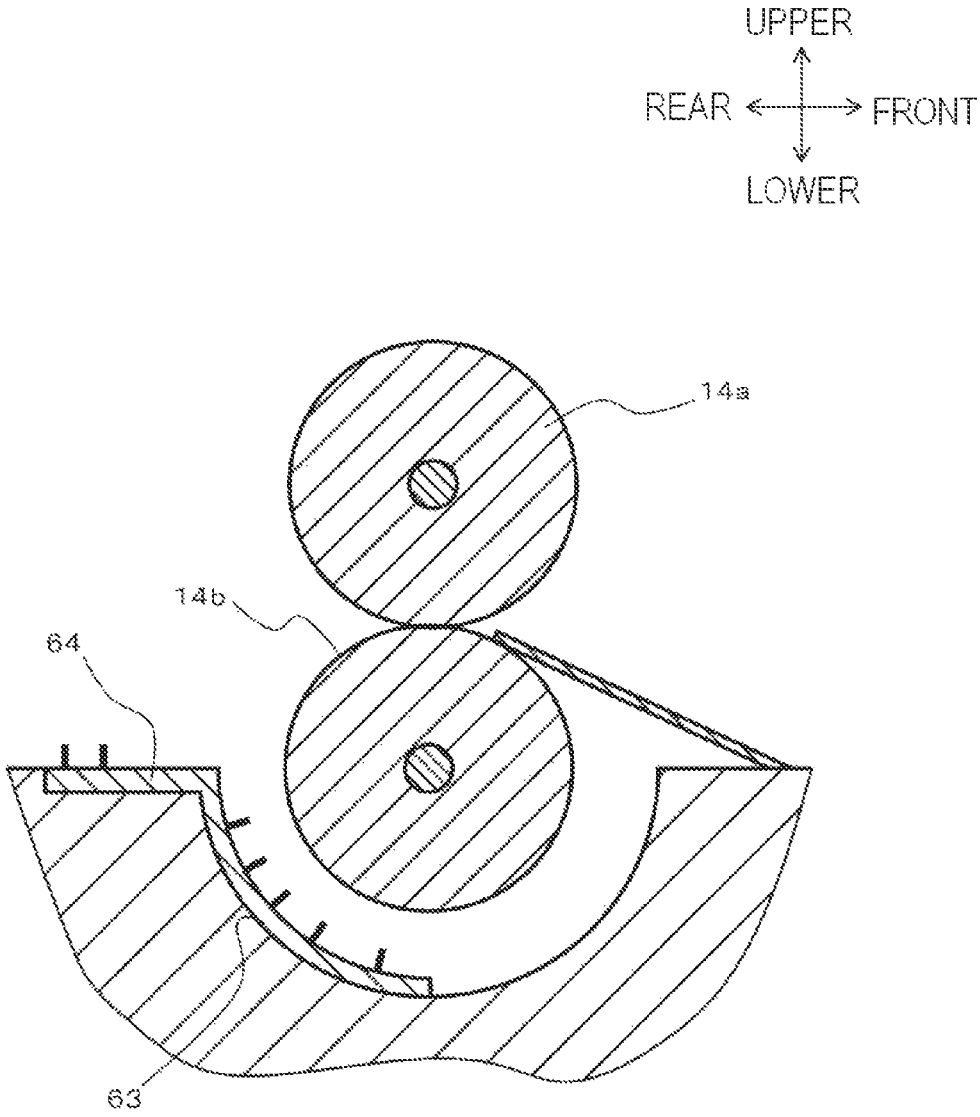
FIG. 8 shows a modified embodiment of a charge removal member using nonwoven fabric.

In the illustrative embodiment, the facing part 73 of the charge removal member 70 is arranged to face the circumferential surface of the lower half part of the register roller 14*b* (circumferential half part of the register roller). However, as shown in FIG. 8, the facing part 73 of the charge removal member 70 may be arranged to face the register roller 14*b* within a range of about 90 degrees.

What is claimed is:

1. An image forming apparatus comprising:

a photosensitive member configured to form a developer image thereon;

a transfer member configured to transfer the developer image formed on the photosensitive member to a sheet being conveyed from an upstream side to a downstream side;

a conveyance roller having a roller body and a rotary shaft, the roller body configured to be rotated about the rotary shaft to convey the sheet toward and between the photosensitive member and the transfer member in a conveyance direction, the conveyance roller being disposed on the upstream side with respect to the transfer member; and a charge removal member configured to remove charges on the conveyance roller, wherein the conveyance roller is arranged to face a surface of the sheet to which the transfer member faces, and wherein the charge removal member is provided at a position at which the charge removal member is not in contact with the conveyance roller, within a range in which the charges on the conveyance roller can be discharged toward the charge removal member, wherein a first distal end of the charge removal member is disposed on an upstream side with respect to the rotary shaft of the conveyance roller in the conveyance direction, wherein a second distal end of the charge removal member is disposed on a downstream side with respect to the rotary shaft of the conveyance roller in the conveyance direction, and wherein the charge removal member includes an arc-shaped part when viewed in the conveyance direction, the arc-shaped part facing the conveyance roller.

2. The image forming apparatus according to claim 1, wherein the charge removal member is made of conductive nonwoven fabric.

3. The image forming apparatus according to claim 2, wherein the roller body covers the rotary shaft and extends along the rotary shaft, and the nonwoven fabric includes a facing part that faces a circumferential surface of the roller body and an extension part that extends from an outer edge of the facing part in a direction away from the roller body.

4. The image forming apparatus according to claim 3, wherein the extension part extends in a direction orthogonal to the rotary shaft, when viewed in a direction of the rotary shaft.

5. The image forming apparatus according to claim 4 further comprising a guide member configured to guide the sheet toward the conveyance roller, the guide member being provided on an upstream side of the conveyance roller with respect to the conveyance direction, wherein the guide member is provided adjacent to the conveyance roller, and wherein the extension part extends toward a downstream side of the conveyance roller with respect to the conveyance direction.

6. The image forming apparatus according to claim 5, wherein a main body of the image forming apparatus has a facing surface that faces a surface of the sheet facing the transfer member when conveying the sheet, the facing surface is provided with a recess part that is concave in a direction away from the surface of the sheet facing the transfer member, when viewed in the direction of the rotary shaft, and wherein the extension part is fitted in the facing surface.

7. The image forming apparatus according to claim 1, wherein the charge removal member is grounded.

8. The image forming apparatus according to claim 1, wherein the conveyance roller is provided in a register roller unit configured to correct a skew of the sheet conveyed between the transfer member and the photosensitive member, and the register roller unit includes a pair of register rollers including the conveyance roller, the pair of rollers being arranged with a conveyance path of the sheet being interposed therebetween, when viewed in a direction of the rotary shaft.

9. The image forming apparatus according to claim 8, wherein both end portions of one of the register rollers in the rotary shaft direction are pressed toward the other one of the register rollers, the other one of the register rollers is arranged at a side of the transfer member with the conveyance path of the sheet being interposed therebetween, and the charge removal member is provided to at least both end portions of the other one of the register rollers in the rotary shaft direction.

* * * * *